US010808975B2

(12) United States Patent
Zha

(10) Patent No.: US 10,808,975 B2
(45) Date of Patent: Oct. 20, 2020

(54) COOLING SYSTEM

(71) Applicant: Heatcraft Refrigeration Products LLC, Stone Mountain, GA (US)

(72) Inventor: Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 170 days.

(21) Appl. No.: 16/001,296

(22) Filed: Jun. 6, 2018

(65) Prior Publication Data

US 2019/0376732 A1 Dec. 12, 2019

(51) Int. Cl.

*F25B 47/02* (2006.01)
*F25B 5/00* (2006.01)
*F25B 47/00* (2006.01)

(52) U.S. Cl.

CPC ..... *F25B 47/025* (2013.01); *F25B 5/00* (2013.01); *F25B 47/006* (2013.01); (Continued)

(58) Field of Classification Search

CPC ..... F25B 47/025; F25B 47/02; F25B 9/10
See application file for complete search history.

(56) References Cited

U.S. PATENT DOCUMENTS 7,367,200 B2 * 5/2008 Ikegami ..... F25B 5/00 62/278
2003/0066300 A1 * 4/2003 Takeuchi ..... B60H 1/3204 62/191

(Continued)

FOREIGN PATENT DOCUMENTS

CA 2530567 A1 6/2007
EP 3021058 A1 5/2016

(Continued)

OTHER PUBLICATIONS

European Patent Office, Extended European Search Report, Application No. 19175804.4, dated Nov. 27, 2019, 5 pages.

*Primary Examiner* — Frantz F Jules
*Assistant Examiner* — Alexis K Cox
(74) *Attorney, Agent, or Firm* — Baker Botts L.L.P.

(57) ABSTRACT

An apparatus includes a flash tank, a medium temperature low side heat exchanger, a low temperature low side heat exchanger, a first compressor, a second compressor, and an ejector. The flash tank stores a refrigerant. The medium temperature low side heat exchanger uses the refrigerant from the flash tank to cool a space proximate the medium temperature low side heat exchanger to a first temperature. The low temperature low side heat exchanger uses the refrigerant from the flash tank to cool a space proximate the low temperature low side heat exchanger to a second temperature that is lower than the first temperature. The first compressor compresses the refrigerant from the low temperature low side heat exchanger. The second compressor compresses the refrigerant from the medium temperature low side heat exchanger. The ejector directs a mixture of the refrigerant from the first compressor and the refrigerant from the second compressor to the low temperature low side heat exchanger during a defrost cycle. The mixture defrosts the low temperature low side heat exchanger. The flash tank receives the mixture.

18 Claims, 3 Drawing Sheets

(52) U.S. Cl.
CPC ..... *F25B 2313/02791* (2013.01); *F25B 2400/053* (2013.01); *F25B 2400/075* (2013.01)

(56) References Cited

U.S. PATENT DOCUMENTS

| | | | | |
|---|---|---|---|---|
| 2008/0098757 | A1* | 5/2008 | Takeuchi | F25B 41/00 62/217 |
| 2009/0232665 | A1* | 9/2009 | Gocho | F04F 5/04 417/151 |
| 2012/0011866 | A1* | 1/2012 | Scarcella | F25B 1/10 62/79 |
| 2012/0167601 | A1* | 7/2012 | Cogswell | F25B 1/10 62/115 |

FOREIGN PATENT DOCUMENTS

| | | | |
|---|---|---|---|
| EP | 3196568 | A1 | 7/2017 |
| WO | 2013078088 | A1 | 5/2013 |

* cited by examiner

COOLING SYSTEM

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration low side heat exchanger. After the refrigerant absorbs heat, it can be cycled back to the refrigeration low side heat exchanger to defrost the refrigeration low side heat exchanger.

SUMMARY

Cooling systems cycle refrigerant to cool various spaces. For example, a refrigeration system cycles refrigerant to cool spaces near or around refrigeration low side heat exchangers. These low side heat exchangers include metal components, such as coils, that carry the refrigerant. As the refrigerant passes through these metallic components, frost and/or ice may accumulate on the exterior of these metallic components. The ice and/or frost reduce the efficiency of the low side heat exchanger. For example, as frost and/or ice accumulates on a low side heat exchanger, it may become more difficult for the refrigerant within the low side heat exchanger to absorb heat that is external to the low side heat exchanger. Typically, the ice and frost accumulate on low side heat exchangers in a low temperature section of the system (e.g., freezer cases).

In existing systems, one way to address frost and/or ice accumulation on the low side heat exchanger is to cycle the refrigerant back to the low side heat exchanger after the refrigerant has absorbed heat from the low side heat exchanger. Usually, discharge from a low temperature compressor is cycled back to the low temperature low side heat exchanger to defrost that low side heat exchanger. In this manner, the heated refrigerant passes over the frost and/or ice accumulation and defrosts the low side heat exchanger. This process of cycling hot refrigerant over frosted and/or iced low side heat exchangers is known as hot gas defrost. Existing cooling systems that have a hot gas defrost cycle use a stepper valve at the low temperature compressor discharge and large piping to regulate the pressure of the hot gas used to defrost the low side heat exchangers. These components take up space and increase the footprint of the cooling system.

This disclosure contemplates a cooling system that can perform hot gas defrost without necessarily using a stepper valve at the low temperature compressor discharge to increase the pressure of the hot gas used to defrost the low side heat exchangers. The cooling system directs refrigerant at a medium temperature compressor discharge to the low side heat exchangers to defrost the low side heat exchangers. In this manner, the cost and footprint of the system is reduced in certain embodiments. Certain embodiments of the cooling system are described below.

According to one embodiment, an apparatus includes a flash tank, a medium temperature low side heat exchanger, a low temperature low side heat exchanger, a first compressor, a second compressor, and an ejector. The flash tank stores a refrigerant. The medium temperature low side heat exchanger uses the refrigerant from the flash tank to cool a space proximate the medium temperature low side heat exchanger to a first temperature. The low temperature low side heat exchanger uses the refrigerant from the flash tank to cool a space proximate the low temperature low side heat exchanger to a second temperature that is lower than the first temperature. The first compressor compresses the refrigerant from the low temperature low side heat exchanger. The second compressor compresses the refrigerant from the medium temperature low side heat exchanger. The ejector directs a mixture of the refrigerant from the first compressor and the refrigerant from the second compressor to the low temperature low side heat exchanger during a defrost cycle. The mixture defrosts the low temperature low side heat exchanger. The flash tank receives the mixture.

According to another embodiment, a method includes storing, by a flash tank, a refrigerant and using, by a medium temperature low side heat exchanger, the refrigerant from the flash tank to cool a space proximate the medium temperature low side heat exchanger to a first temperature. The method also includes using, by a low temperature low side heat exchanger, the refrigerant from the flash tank to cool a space proximate the low temperature low side heat exchanger to a second temperature that is lower than the first temperature and compressing, by a first compressor, the refrigerant from the low temperature low side heat exchanger. The method further includes compressing, by a second compressor, the refrigerant from the medium temperature low side heat exchanger and directing, by an ejector, a mixture of the refrigerant from the first compressor and the refrigerant from the second compressor to the low temperature low side heat exchanger during a defrost cycle. The mixture defrosts the low temperature low side heat exchanger. The method also includes receiving, by the flash tank, the mixture.

According to yet another embodiment, a system includes a high side heat exchanger, a flash tank, a medium temperature low side heat exchanger, a low temperature low side heat exchanger, a first compressor, a second compressor, and an ejector. The high side heat exchanger removes heat from a refrigerant. The flash tank stores the refrigerant. The medium temperature low side heat exchanger uses the refrigerant from the flash tank to cool a space proximate the medium temperature low side heat exchanger to a first temperature. The low temperature low side heat exchanger uses the refrigerant from the flash tank to cool a space proximate the low temperature low side heat exchanger to a second temperature that is lower than the first temperature. The first compressor compresses the refrigerant from the low temperature low side heat exchanger. The second compressor compresses the refrigerant from the medium temperature low side heat exchanger. The ejector directs a mixture of the refrigerant from the first compressor and the refrigerant from the second compressor to the low temperature low side heat exchanger during a defrost cycle. The mixture defrosts the low temperature low side heat exchanger. The flash tank receives the mixture.

Certain embodiments may provide one or more technical advantages. For example, an embodiment reduces the size of the piping used in existing cooling systems. As another example, an embodiment removes a stepper valve used in existing cooling systems. As yet another example, an embodiment reduces the amount of refrigerant in the cooling system and reduces the energy used by the cooling system. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
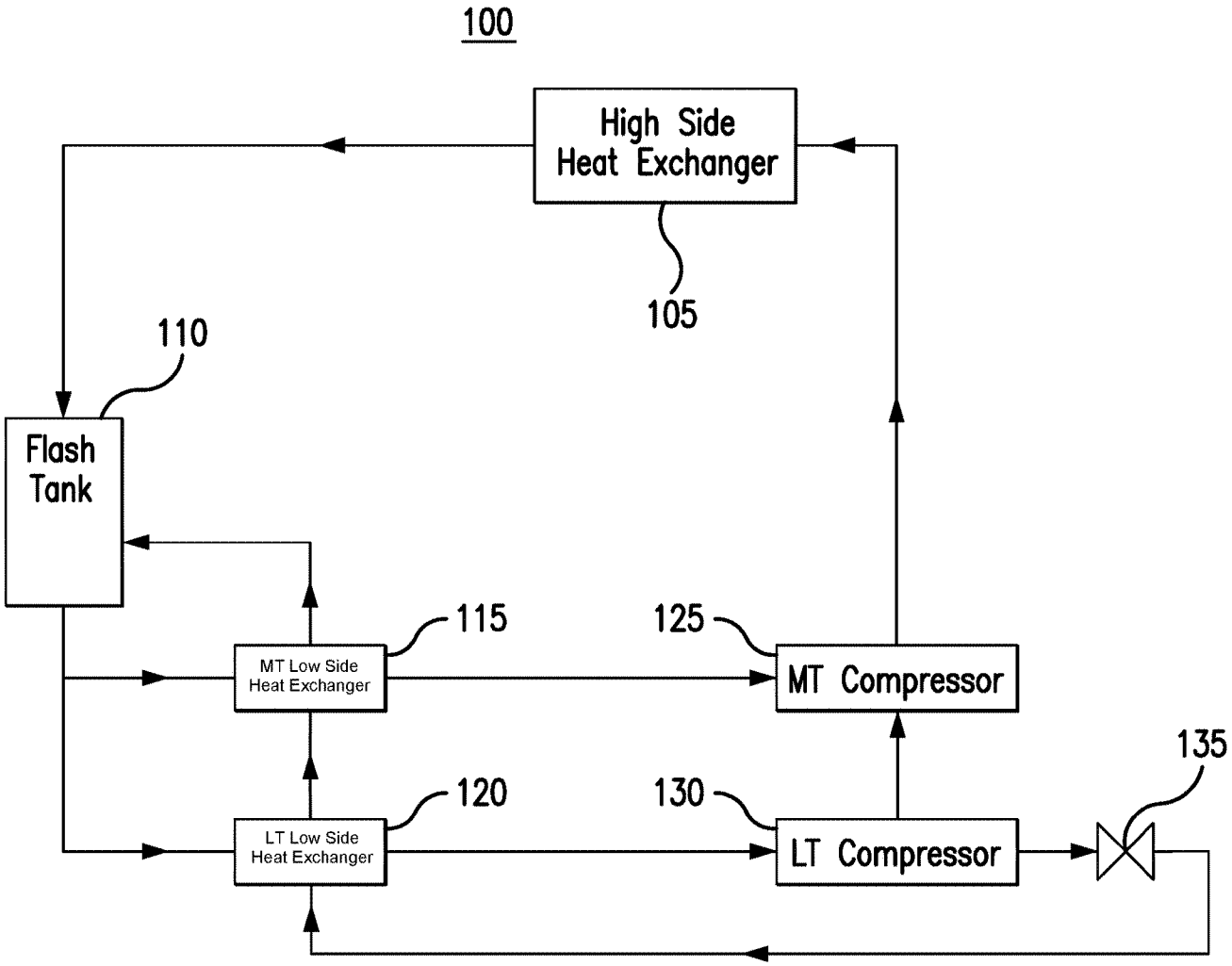
FIG. 1 (Prior Art)
FIG. 1 illustrates an example cooling system.
Figure 2:
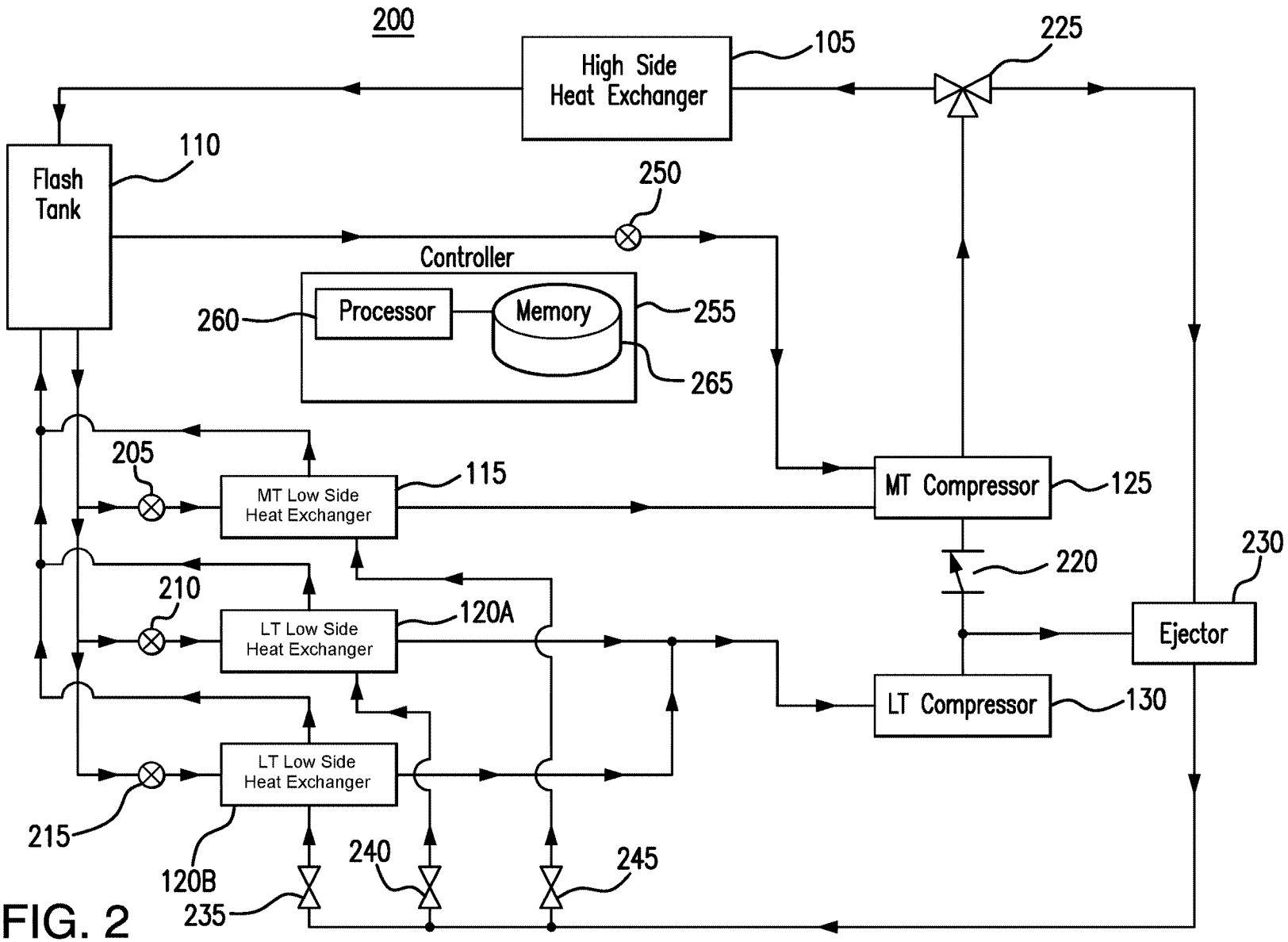
FIG. 2 illustrates an example cooling system.
Figure 3:
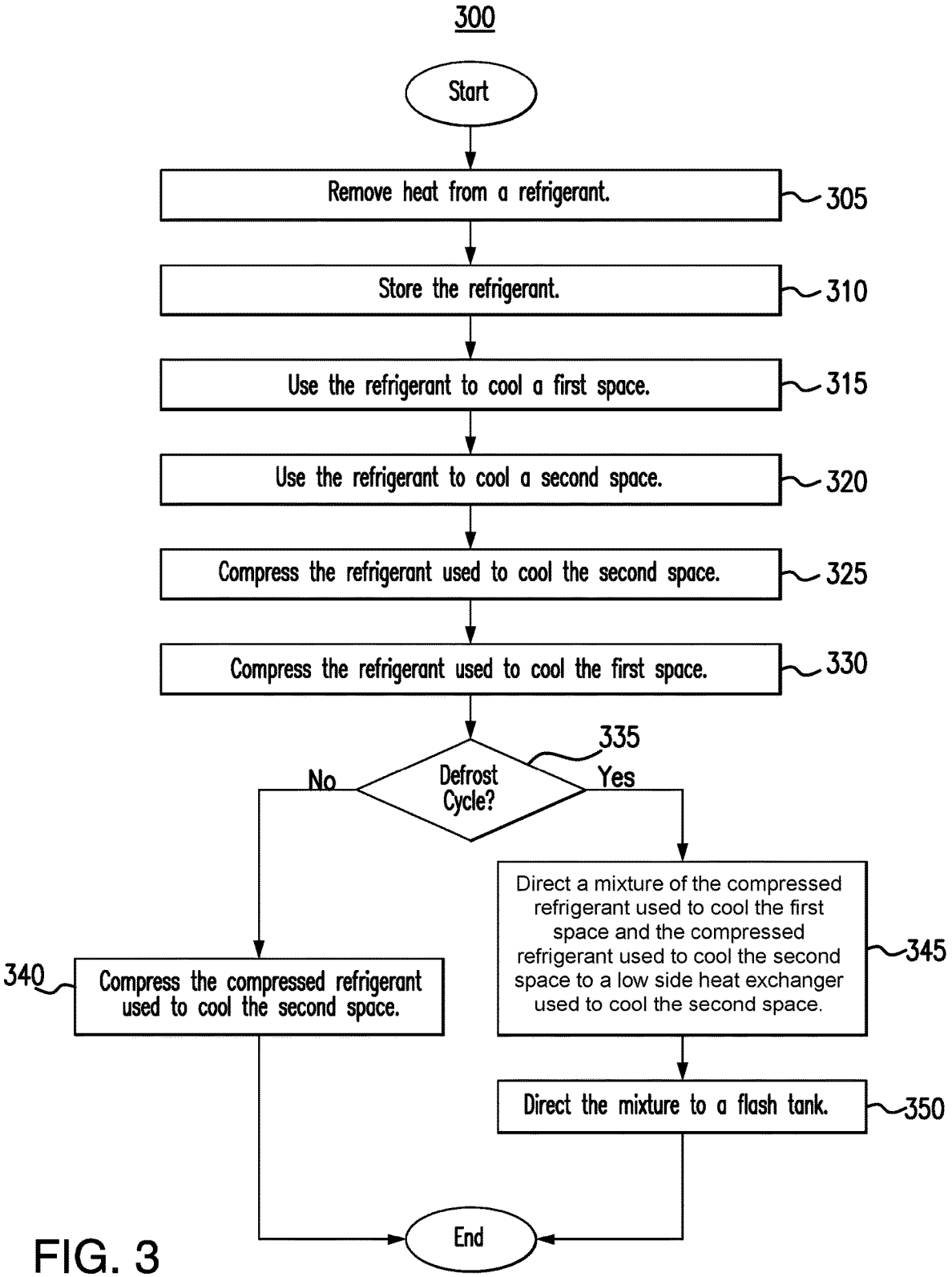
FIG. 3 is a flowchart illustrating a method of operating the example cooling system of FIG. 2.

Embodiments of the present disclosure and its advantages are best understood by referring to FIGS. 1 through 3 of the drawings, like numerals being used for like and corresponding parts of the various drawings.

Cooling systems cycle refrigerant to cool various spaces. For example, a refrigeration system cycles refrigerant to cool spaces near or around refrigeration low side heat exchangers. These low side heat exchangers include metal components, such as coils, that carry the refrigerant. As the refrigerant passes through these metallic components, frost and/or ice may accumulate on the exterior of these metallic components. The ice and/or frost reduce the efficiency of the low side heat exchanger. For example, as frost and/or ice accumulates on a low side heat exchanger, it may become more difficult for the refrigerant within the low side heat exchanger to absorb heat that is external to the low side heat exchanger. Typically, the ice and frost accumulate on low side heat exchangers in a low temperature section of the system (e.g., freezer cases).

In existing systems, one way to address frost and/or ice accumulation on the low side heat exchanger is to cycle the refrigerant back to the low side heat exchanger after the refrigerant has absorbed heat from the low side heat exchanger. Usually, discharge from a low temperature compressor is cycled back to the low temperature low side heat exchanger to defrost that low side heat exchanger. In this manner, the heated refrigerant passes over the frost and/or ice accumulation and defrosts the low side heat exchanger. This process of cycling hot refrigerant over frosted and/or iced low side heat exchangers is known as hot gas defrost.

Existing cooling systems that have a hot gas defrost cycle use a stepper valve to build up discharge pressure for hot gas defrost. For example, the stepper valve may increase the pressure of the refrigerant from 28 bar to 40 bar. After the hot gas is used to defrost the low side heat exchanger, the gas is pumped to a flash tank that usually stores refrigerant at 36 bar. The small pressure difference between the hot gas supply and the flash tank (for example, 40 bar−36 bar=4 bar) results in the need for large piping to limit the pressure drop across the hot gas/refrigerant line. If the pressure drop across the hot gas/refrigerant is too large, then the pressure at the flash tank may overtake the pressure at the stepper valve and the flow of the hot gas may reverse and/or stop. The large piping increases the material cost of the refrigeration system and it increases the amount of space occupied by the refrigeration system.

This disclosure contemplates a cooling system that can perform hot gas defrost without necessarily using a stepper valve at the low temperature compressor discharge to increase the pressure of the hot gas used to defrost the low side heat exchangers. The cooling system directs refrigerant at a medium temperature compressor discharge to the low side heat exchangers to defrost the low side heat exchangers. In this manner, the cost and footprint of the system is reduced in certain embodiments. In some embodiment, the cooling system reduces the amount of refrigerant in the cooling system and reduces the energy used by the cooling system. The cooling system will be described using FIGS. 1 through 3. FIG. 1 will describe an existing cooling system with hot gas defrost. FIGS. 2 and 3 describe the cooling system with improved hot gas defrost.

FIG. 1 illustrates an example cooling system 100. As shown in FIG. 1, system 100 includes a high side heat exchanger 105, a flash tank 110, a medium temperature low side heat exchanger 115, a low temperature low side heat exchanger 120, a medium temperature compressor 125, a low temperature compressor 130, and a valve 135. By operating valve 135, system 100 allows for hot gas to be circulated to low temperature low side heat exchanger 120 to defrost low temperature low side heat exchanger 120. After defrosting low temperature low side heat exchanger 120, the hot gas and/or refrigerant is cycled back to flash tank 110.

High side heat exchanger 105 removes heat from a refrigerant. When heat is removed from the refrigerant, the refrigerant is cooled. This disclosure contemplates high side heat exchanger 105 being operated as a condenser, a fluid cooler, and/or a gas cooler. When operating as a condenser, high side heat exchanger 105 cools the refrigerant such that the state of the refrigerant changes from a gas to a liquid. When operating as a fluid cooler, high side heat exchanger 105 cools liquid refrigerant and the refrigerant remains a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature low side heat exchanger 120 and medium temperature low side heat exchanger 115. In some embodiments, a flash gas and/or a gaseous refrigerant is released from flash tank 110. By releasing flash gas, the pressure within flash tank 110 may be reduced.

System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature low side heat exchanger 120 and medium temperature low side heat exchanger 115. When the refrigerant reaches low temperature low side heat exchanger 120 or medium temperature low side heat exchanger 115, the refrigerant removes heat from the air around low temperature low side heat exchanger 120 or medium temperature low side heat exchanger 115. As a result, the air is cooled. The cooled air may then be circulated such as, for example, by a fan to cool a space such as, for example, a freezer and/or a refrigerated shelf. As refrigerant passes through low temperature low side heat exchanger 120 and medium temperature low side heat exchanger 115 the refrigerant may change from a liquid state to a gaseous state as it absorbs heat.

The refrigerant cools metallic components of low temperature low side heat exchanger 120 and medium temperature low side heat exchanger 115 as the refrigerant passes through low temperature low side heat exchanger 120 and medium temperature low side heat exchanger 115. For example, metallic coils, plates, parts of low temperature low side heat exchanger 120 and medium temperature low side heat exchanger 115 may cool as the refrigerant passes through them. These components may become so cold that vapor in the air external to these components condenses and eventually freeze or frost onto these components. As the ice or frost accumulates on these metallic components, it may become more difficult for the refrigerant in these components to absorb heat from the air external to these components. In essence, the frost and ice acts as a thermal barrier. As a result, the efficiency of cooling system 100 decreases the more ice and frost that accumulates. Cooling system 100 may use heated refrigerant to defrost these metallic components.

Refrigerant flows from low temperature low side heat exchanger 120 and medium temperature low side heat exchanger 115 to compressors 125 and 130. This disclosure contemplates system 100 including any number of low temperature compressors 130 and medium temperature compressors 125. Both the low temperature compressor 130 and medium temperature compressor 125 compress refrigerant to increase the pressure of the refrigerant. As a result, the heat in the refrigerant may become concentrated and the refrigerant may become a high-pressure gas. Low temperature compressor 130 compresses refrigerant from low temperature low side heat exchanger 120 and sends the compressed refrigerant to medium temperature compressor 125. Medium temperature compressor 125 compresses a mixture of the refrigerant from low temperature compressor 130 and medium temperature low side heat exchanger 115. Medium temperature compressor 125 then sends the compressed refrigerant to high side heat exchanger 105.

Valve 135 may be opened or closed to cycle refrigerant from low temperature compressor 130 back to low temperature low side heat exchanger 120. The refrigerant may be heated after absorbing heat from low temperature low side heat exchanger 120 and being compressed by low temperature compressor 130. The hot refrigerant and/or hot gas is then cycled over the metallic components of low temperature low side heat exchanger 120 to defrost those components. Afterwards, the hot gas and/or refrigerant is cycled back to flash tank 110.

Valve 135 includes a stepper valve that increases the pressure of the hot gas and/or refrigerant so that it can be cycled back to low temperature low side heat exchanger 120 to defrost low temperature low side heat exchanger 120. For example, the stepper valve may increase the pressure of the hot gas and/or refrigerant from 28 bar to 40 bar. The stepper valve is needed so that the pressure of the hot gas and/or refrigerant can be increased above the pressure of flash tank 110 (the pressure of flash tank 110 may be 36 bar, for example). In this manner, the hot gas and/or refrigerant may be at a high enough pressure to be cycled back into flash tank 110.

In this example, the pressure difference between the hot gas and/or refrigerant and flash tank 110 may be around 4 bar because the stepper valve increases the pressure of the refrigerant to 40 bar and flash tank 110 is held at 36 bar. This difference in pressure of 4 bar is small and results in system 100 needing large piping to limit the pressure drop of the hot gas and/or refrigerant as it defrosts low temperature low side heat exchanger 120 and then travels to flash tank 110. If the pressure drop across the hot gas and/or refrigerant line is too large, then the pressure at flash tank 110 may overcome the pressure at the stepper valve and the flow of hot gas and/or refrigerant may reverse and/or stop. The large piping results in increased cost and a larger footprint for system 100.

This disclosure contemplates a cooling system that can perform hot gas defrost without necessarily using a stepper valve and/or large piping to regulate the pressure of the hot gas. The system uses the refrigerant at the discharge of the medium temperature compressor to perform hot gas defrost. In this manner, the cost and/or footprint of the cooling system is reduced in certain embodiments. Embodiments of the cooling system are described below using FIGS. 2 and 3.

FIG. 2 illustrates an example cooling system 200. As shown in FIG. 2, system 200 includes a high side heat exchanger 105, a flash tank 110, a medium temperature low side heat exchanger 115, low temperature low side heat exchangers 120A and 120B, a medium temperature compressor 125, a low temperature compressor 130, valves 205, 210, and 215, valve 220, valve 225, ejector 230, valves 235, 240, and 245, valve 250, and controller 255. System 200 can perform hot gas defrost on one or more of medium temperature low side heat exchanger 115, low temperature low side heat exchanger 120A, and low temperature low side heat exchanger 120B without necessarily using a stepper valve. In this manner, system 200 has a reduced cost and or footprint over existing systems in certain embodiments.

Generally, high side heat exchanger 105, flash tank 110, medium temperature low side heat exchanger 115, low temperature low side heat exchanger 120A, low temperature low side heat exchanger 120B, medium temperature compressor 125, and low temperature compressor 130 operate similarly as they did in system 100. For example, high side heat exchanger 105 removes heat from a refrigerant. Flash tank 110 stores the refrigerant. Medium temperature low side heat exchanger 115, low temperature low side heat exchanger 120A, and low temperature low side heat exchanger 120B use the refrigerant to cool a space prominent those low side heat exchangers. Low temperature compressor 130 compresses the refrigerant from low temperature low side heat exchangers 120A and 120B. Medium temperature compressor 125 compresses refrigerant from medium temperature low side heat exchanger 115. These components operate together to cool a space proximate the low side heat exchangers.

System 200 includes valves 205, 210, and 215 between flash tank 110 and medium temperature low side heat exchanger 115, low temperature low side heat exchanger 120A, and low temperature low side heat exchanger 120B. Valves 205, 210, and 215 control the flow of refrigerant from flash tank 110 to medium temperature low side heat exchanger 115, low temperature low side heat exchanger 120A, and low temperature low side heat exchanger 120B. For example, when valve 205 is open, refrigerant flows from flash tank 110 to medium temperature low side heat exchanger 115. When valve 205 is closed, refrigerant from flash tank 110 is not able to flow to medium temperature low side heat exchanger 115. As another example, when valve 210 is open refrigerant from flash tank 110 is able to flow to low temperature low side heat exchanger 120A. When valve 210 is closed, refrigerant from flash tank 110 is not able to flow to low temperature low side heat exchanger 120A. As yet another example, when valve 215 is open, refrigerant from flash tank 110 is able to flow to low temperature low side heat exchanger 120B. When valve 215 is closed, refrigerant from flash tank 110 is not able to flow to low temperature low side heat exchanger 120B.

One or more of valves 205, 210, and 215 can be opened when one or more of medium temperature low side heat exchanger 115, low temperature 120A, and low temperature 120B are in operation. One or more valves 205, 210 and 215 can be closed when one or more of medium temperature low side heat exchanger 115, low temperature low side heat exchanger 120A, and low temperature low side heat exchanger 120B are not in operation. For example, when medium temperature low side heat exchanger 115, low temperature low side heat exchanger 120A, and/or low temperature low side heat exchanger 120B are in a defrost cycle, their respective valves 205, 210, and 215 are closed. After the defrost cycle is completed, one or more of valves 205, 210, and 215 can be opened again to continue operation of medium temperature low side heat exchanger 115, low temperature 120A, and/or low temperature low side heat exchanger 120B.

Valves 205, 210, and 215 are used to cool refrigerant entering low side heat exchangers 115, 120A, and 120B. Valves 205, 210, and 215 may receive refrigerant from any component of system 200 such as for example high side heat exchanger 105 and/or flash tank 110. Valves 205, 210, and 215 reduce the pressure and therefore the temperature of the refrigerant. Valves 205, 210, and 215 reduce pressure from the refrigerant flowing into the valves 205, 210, and 215. The temperature of the refrigerant may then drop as pressure is reduced. As a result, refrigerant entering valves 205, 210, and 215 may be cooler when leaving valves 205, 210, and 215. The refrigerant leaving valve 205 is fed to low side heat exchanger 115. The refrigerant leaving valve 210 is fed to low side heat exchanger 120A. The refrigerant leaving valve 215 is fed to low side heat exchanger 120B.

Valve 220, valve 225, ejector 230, valve 235, valve 240, and valve 245 control one or more defrost cycles of system 200. During each defrost cycle, one or more of medium temperature low side heat exchanger 115, low temperature low side heat exchanger 120A, and low temperature low side heat exchanger 120B are defrosted. A mixture of the hot gas discharge from medium temperature compressor 125 and low temperature compressor 130 is directed to the low side heat exchanger that is being defrosted. That mixture defrosts the low side heat exchanger and is directed back to flash tank 110. In this manner, one or more defrost cycles may be performed without necessarily using a stepper valve in certain embodiments.

Valve 220 controls the flow of refrigerant between low temperature compressor 130 and medium temperature compressor 125. In certain embodiments, valve 220 is a check valve that allows refrigerant to flow from low temperature compressor 130 to medium temperature compressor 125 if the pressure of that refrigerant exceeds a threshold. The threshold may be an internal pressure threshold of valve 220. When the pressure of the refrigerant does not exceed that threshold, valve 220 prevents the refrigerant from flowing from low temperature compressor 130 to medium temperature compressor 125. Instead, the refrigerant flows from low temperature compressor 130 to ejector 230. When the pressure of the refrigerant exceeds the internal pressure threshold of valve 220, valve 220 opens and a portion of the refrigerant from low temperature compressor 130 flows to medium temperature compressor 125. Even though valve 220 is opened, a portion of the refrigerant from low temperature compressor 130 may continue to flow to ejector 230.

Valve 225 controls the flow of refrigerant from medium temperature compressor 125. In certain embodiments valve 225 is a three-way valve. Valve 225 receives the refrigerant from medium temperature compressor 125. Valve 225 then directs the refrigerant either to high side heat exchanger 105 or to ejector 230. During a defrost cycle, valve 225 directs the refrigerant to ejector 230. After the defrost cycle is complete, valve 225 directs the refrigerant to high side heat exchanger 105. In certain embodiments, valve 225 may direct a portion of the refrigerant to ejector 230 and a portion to high side heat exchanger 105.

Ejector 230 directs a mixture of refrigerant from low temperature compressor 130 and refrigerant from medium temperature compressor 125 to valves 235, 240, and/or 245 during a defrost cycle. In certain embodiments, ejector 230 recovers the throttling energy of the process of reducing discharge pressor. As discussed previously, this process increases the pressure of some of the refrigerant from the low temperature compressor 130 so that the refrigerant can flow to flash tank 110.

Valves 235, 240, and 245 control the flow of hot gas to medium temperature low side heat exchanger 115, low temperature low side heat exchanger 120A, and low temperature low side heat exchanger 120B. During a defrost cycle, one or more of valves 235, 240*m* and 245 are opened to allow hot gas to flow to one or more of medium temperature low side heat exchanger 115, low temperature low side heat exchanger 120A, and low temperature low side heat exchanger 120B. For example, during a first defrost cycle, valve 235 may be opened to allow hot gas from ejector 230 to flow to low temperature low side heat exchanger 120B. The hot gas defrosts low temperature low side heat exchanger 120B and flows to flash tank 110. After the first defrost cycle is complete, valve 235 may close to prevent hot gas from flowing to low temperature low side heat exchanger 120B. During a second defrost cycle, valve 240 may be opened to allow hot gas from ejector 230 to flow to low temperature low side heat exchanger 120A. The hot gas defrosts low temperature low side heat exchanger 120A and flows to flash tank 110. After the second defrost cycle is complete, valve 240 may close to prevent hot gas from flowing to low temperature low side heat exchanger 120A. During a third defrost cycle, valve 245 is opened to allow hot gas to flow from ejector 230 to medium temperature low side heat exchanger 115. The hot gas defrosts medium temperature low side heat exchanger 115 and flows to flash tank 110. After the first defrost cycle is complete, valve 245 may close to prevent hot gas from flowing to medium temperature low side heat exchanger 115.

As mentioned previously, when a defrost cycle is occurring for a low side heat exchanger, the corresponding valve 205, 210, or 215 for that low side heat exchanger closes to prevent refrigerant from flowing from flash tank 110 to that low side heat exchanger. Using the previous example, during the first defrost cycle, valve 215 may close to prevent refrigerant from flowing from flash tank 110 to low temperature low side heat exchanger 120B. During the second defrost cycle, valve 210 may close to prevent refrigerant from flowing from flash tank 110 to low temperature low side heat exchanger 120A. During the third defrost cycle, valve 205 may close to prevent refrigerant from flowing from flash tank 110 to medium temperature low side heat exchanger 115.

Flash tank 110 receives the hot gas used to defrost the low side heat exchangers loads. Flash tank 110 may discharge that gas along with flash gas in flash tank 110. Valve 250 controls the flow of flash gas and/or hot gas from flash tank 110, and thus the internal pressure of flash tank 110. When valve 250 is opened more, it increases the flow of hot gas and/or flash gas from flash tank 110 to medium temperature compressor 125, and the flash tank pressure decreases. When valve 250 is opened less, it decreases the flow of flash gas and/or hot gas, which may cause the flash tank pressure to increase. Medium temperature compressor 125 compresses the flash gas and/or hot gas and directs the compressed hot gas and/or flash gas to valve 225.

Controller 255 includes processor 260 and memory 265. This disclosure contemplates processor 260 and memory 265 being configured to perform and of the functions of controller 255 described herein. Generally, controller 255 controls valves 205, 210, 225, 235, 240, and 245 to control one or more defrost cycles.

Processor 260 is any electronic circuitry, including, but not limited to microprocessors, application specific integrated circuits (ASIC), application specific instruction set processor (ASIP), and/or state machines, that communicatively couples to memory 265 and controls the operation of controller 255. Processor 260 may be 8-bit, 16-bit, 32-bit, 64-bit or of any other suitable architecture. Processor 260 may include an arithmetic logic unit (ALU) for performing arithmetic and logic operations, processor registers that supply operands to the ALU and store the results of ALU operations, and a control unit that fetches instructions from memory and executes them by directing the coordinated operations of the ALU, registers and other components. Processor 260 may include other hardware and software that operates to control and process information. Processor 260 executes software stored on memory 265 to perform any of the functions described herein. Processor 260 controls the operation and administration of controller 255 by processing information received from various components of system 200. Processor 260 may be a programmable logic device, a microcontroller, a microprocessor, any suitable processing device, or any suitable combination of the preceding. Processor 260 is not limited to a single processing device and may encompass multiple processing devices.

Memory 265 may store, either permanently or temporarily, data, operational software, or other information for processor 260. Memory 265 may include any one or a combination of volatile or non-volatile local or remote devices suitable for storing information. For example, memory 265 may include random access memory (RAM), read only memory (ROM), magnetic storage devices, optical storage devices, or any other suitable information storage device or a combination of these devices. The software represents any suitable set of instructions, logic, or code embodied in a computer-readable storage medium. For example, the software may be embodied in memory 265, a disk, a CD, or a flash drive. In particular embodiments, the software may include an application executable by processor 260 to perform one or more of the functions of controller 255 described herein.

In certain embodiments, controller 255 determines when to activate a defrost cycle. Controller 255 may make this determination based on any suitable criteria. For example, controller 255 may activate a defrost cycle when it determines that a sufficient amount of ice and/or frost have accumulated on a low side heat exchanger. As another example, controller 255 may activate a defrost cycle based on a timer so that a low side heat exchanger undergoes a defrost cycle periodically. Controller 255 may utilize any number of temperature sensors, pressure sensors, moisture/humidity sensors, ice/frost sensors, and/or timers to determine when to activate a defrost cycle.

As an example, controller 255 may use a temperature sensor, moisture/humidity sensor, or ice/frost sensor to determine that ice or frost has accumulated on low temperature low side heat exchanger 120A. In response, controller 255 closes valve 210 and adjusts valve 225 to direct refrigerant to ejector 230. Controller 255 then opens valve 240 so that discharge from ejector 230 flows to low temperature low side heat exchanger 120A. That discharge defrosts low temperature low side heat exchanger 120A and flows to flash tank 110. After the defrost cycle is complete, controller 255 closes valve 240 and adjusts valve 225 to direct refrigerant to high side heat exchanger 105. Controller 255 then opens valve 210 so that low temperature low side heat exchanger 120A can begin operating again. Controller 255 performs analogous processes to defrost medium temperature low side heat exchanger 115 and low temperature low side heat exchanger 120B.

In this manner, system 200 performs hot gas defrost without necessarily using a stepper valve. As a result, system 200 uses less energy and/or less refrigerant than existing systems that perform hot gas defrosts in certain embodiments. As a result, the cost and footprint of system 200 are decreased in some embodiments.

This disclosure may refer to a refrigerant being from a particular component of system 200 (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the medium temperature compressor) even though there may be other intervening components between the particular component and the destination of the refrigerant. For example, the medium temperature low side heat exchanger receives a refrigerant from the flash tank even though there is an expansion valve between the flash tank and the medium temperature low side heat exchanger.

FIG. 3 is a flow chart illustrating a method 300 of operating the example cooling system 200 of FIG. 2. In particular embodiments, various components of system 200 perform the steps of method 300. In this manner, the amount of energy and/or refrigerant in the cooling system is reduced in some embodiments. Additionally, the cost and footprint of the system are reduced in certain embodiments.

A high side heat exchanger begins by removing heat from a refrigerant in step 305. In step 310, a flash tank stores the refrigerant. A medium temperature low side heat exchanger uses the refrigerant to cool a first space in step 315. In step 320, a low temperature low side heat exchanger uses the refrigerant to cool a second space. A low temperature compressor compresses the refrigerant used to cool a second space in step 325. In step 330, a medium temperature compressor compresses the refrigerant used to cool the first space.

In step 335, a determination is made whether a hot gas defrost cycle should be activated. In some embodiments, a controller that includes a hardware processor and memory performs step 335. For example, the controller may detect whether ice and/or frost are accumulating on a low side heat exchanger. The controller may activate the defrost cycle if it determines that ice and/or frost are accumulating on the low side heat exchanger. If the controller determines that no ice and/or frost are accumulating on the low side heat exchanger or if an insufficient amount of ice or frost are accumulating on the low side heat exchanger, the controller may determine not to activate the defrost cycle. In step 340, if the controller determines that the defrost cycle should not be activated, the medium temperature compressor compresses the compressed refrigerant used to cool the second space. That refrigerant may then be directed to the high side heat exchanger.

If the controller determines that the defrost cycle should be activated, an ejector directs a mixture of the compressed refrigerant used to cool the first space and the compressed refrigerant used to cool the second space to a low side heat exchanger used to cool the second space such as, for example, a low temperature low side heat exchanger. The mixture then defrosts the low side heat exchanger. In step 350, the mixture is directed to the flash tank after it has been used to defrost the low side heat exchanger.

Modifications, additions, or omissions may be made to method 300 depicted in FIG. 3. Method 300 may include more, fewer, or other steps. For example, steps may be performed in parallel or in any suitable order. While discussed as system 200 (or components thereof) performing the steps, any suitable component of system 200 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a flash tank that stores a refrigerant;

a medium temperature low side heat exchanger configured to use the refrigerant from the flash tank to cool a space proximate the medium temperature low side heat exchanger to a first temperature;

a low temperature low side heat exchanger configured to use the refrigerant from the flash tank to cool a space proximate the low temperature low side heat exchanger to a second temperature that is lower than the first temperature;

a first compressor configured to compress the refrigerant from the low temperature low side heat exchanger;

a second compressor configured to compress the refrigerant from the medium temperature low side heat exchanger; and an ejector that directs a mixture of the refrigerant from the first compressor and the refrigerant from the second compressor to the low temperature low side heat exchanger during a defrost cycle, the mixture defrosts the low temperature low side heat exchanger, the flash tank receives the mixture; and a valve that directs the refrigerant from the second compressor to the ejector during the defrost cycle and to the high side heat exchanger after the defrost cycle ends.

2. The apparatus of claim 1, further comprising a valve that directs a portion of the mixture from the flash tank to the second compressor.

3. The apparatus of claim 1, further comprising a valve that directs a portion of the refrigerant from the first compressor to the second compressor when a pressure of the refrigerant from the first compressor exceeds a threshold.

4. The apparatus of claim 1, further comprising a second low temperature low side heat exchanger configured to use the refrigerant from the flash tank to cool a space proximate the second low temperature low side heat exchanger, the second compressor further configured to compress the refrigerant from the second low temperature low side heat exchanger, the ejector further directs the mixture to the second low temperature low side heat exchanger during a second defrost cycle.

5. The apparatus of claim 1, further comprising a valve that stops a flow of the refrigerant from the flash tank to the low temperature low side heat exchanger during the defrost cycle.

6. The apparatus of claim 1, wherein the ejector further directs the mixture to the medium temperature low side heat exchanger during a third defrost cycle.

7. A method comprising:

storing, by a flash tank, a refrigerant from a high side heat exchanger;

using, by a medium temperature low side heat exchanger, the refrigerant from the flash tank to cool a space proximate the medium temperature low side heat exchanger to a first temperature;

using, by a low temperature low side heat exchanger, the refrigerant from the flash tank to cool a space proximate the low temperature low side heat exchanger to a second temperature that is lower than the first temperature;

compressing, by a first compressor, the refrigerant from the low temperature low side heat exchanger;

compressing, by a second compressor, the refrigerant from the medium temperature low side heat exchanger;

directing, by an ejector, a mixture of the refrigerant from the first compressor and the refrigerant from the second compressor to the low temperature low side heat exchanger during a defrost cycle, the mixture defrosts the low temperature low side heat exchanger;

receiving, by the flash tank, the mixture; and directing, by a valve, the refrigerant from the second compressor to the ejector during the defrost cycle and to the high side heat exchanger after the defrost cycle ends.

8. The method of claim 7, further comprising directing, by a valve, a portion of the mixture from the flash tank to the second compressor.

9. The method of claim 7, further comprising directing, by a valve, a portion of the refrigerant from the first compressor to the second compressor when a pressure of the refrigerant from the first compressor exceeds a threshold.

10. The method of claim 7, further comprising:

using, by a second low temperature low side heat exchanger, the refrigerant from the flash tank to cool a space proximate the second low temperature low side heat exchanger;

compressing, by the second compressor, the refrigerant from the second low temperature low side heat exchanger; and directing, by the ejector, the mixture to the second low temperature low side heat exchanger during a second defrost cycle.

11. The method of claim 7, further comprising stopping, by a valve, a flow of the refrigerant from the flash tank to the low temperature low side heat exchanger during the defrost cycle.

12. The method of claim 7, further comprising directing, by the ejector, the mixture to the medium temperature low side heat exchanger during a third defrost cycle.

13. A system comprising:

a high side heat exchanger configured to remove heat from a refrigerant;

a flash tank that stores the refrigerant from the high side heat exchanger;

a medium temperature low side heat exchanger configured to use the refrigerant from the flash tank to cool a space proximate the medium temperature low side heat exchanger to a first temperature;

a low temperature low side heat exchanger configured to use the refrigerant from the flash tank to cool a space proximate the low temperature low side heat exchanger to a second temperature that is lower than the first temperature;

a first compressor configured to compress the refrigerant from the low temperature low side heat exchanger;

a second compressor configured to compress the refrigerant from the medium temperature low side heat exchanger;

an ejector configured to direct a mixture of the refrigerant from the first compressor and the refrigerant from the second compressor to the low temperature low side heat exchanger during a defrost cycle, the mixture defrosts the low temperature low side heat exchanger, the flash tank receives the mixture; and a valve that directs the refrigerant from the second compressor to the ejector during the defrost cycle and to the high side heat exchanger after the defrost cycle ends.

14. The system of claim 13, further comprising a valve that directs a portion of the mixture from the flash tank to the second compressor.

15. The system of claim 13, further comprising a valve that directs a portion of the refrigerant from the first compressor to the second compressor when a pressure of the refrigerant from the first compressor exceeds a threshold.

16. The system of claim 13, further comprising a second low temperature low side heat exchanger configured to use the refrigerant from the flash tank to cool a space proximate the second low temperature low side heat exchanger, the second compressor further configured to compress the refrigerant from the second low temperature low side heat exchanger, the ejector directs the mixture to the second low temperature low side heat exchanger during a second defrost cycle.

17. The system of claim 13, further comprising a valve that stops a flow of the refrigerant from the flash tank to the low temperature low side heat exchanger during the defrost cycle.

18. The system of claim 13, wherein the ejector directs the mixture to the medium temperature low side heat exchanger during a third defrost cycle.

* * * * *